US011573056B2

(12) United States Patent
Yatsuyanagi et al.

(10) Patent No.: US 11,573,056 B2
(45) Date of Patent: Feb. 7, 2023

(54) HEAT EXCHANGER, HEAT EXCHANGER UNIT, AND REFRIGERATION CYCLE APPARATUS

(71) Applicant: Mitsubishi Electric Corporation, Tokyo (JP)

(72) Inventors: Akira Yatsuyanagi, Tokyo (JP); Akira Ishibashi, Tokyo (JP); Tsuyoshi Maeda, Tokyo (JP); Shin Nakamura, Tokyo (JP); Ryuichi Nagata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 126 days.

(21) Appl. No.: 17/057,002

(22) PCT Filed: Jul. 11, 2018

(86) PCT No.: PCT/JP2018/026186
§ 371 (c)(1),
(2) Date: Nov. 19, 2020

(87) PCT Pub. No.: WO2020/012577
PCT Pub. Date: Jan. 16, 2020

(65) Prior Publication Data

US 2021/0108864 A1 Apr. 15, 2021

(51) Int. Cl.
*F28F 1/32* (2006.01)
*F25B 39/02* (2006.01)
(Continued)

(52) U.S. Cl.
CPC ..... *F28F 1/325* (2013.01); *F25B 39/02* (2013.01); *F28D 2021/0068* (2013.01);
(Continued)

(58) Field of Classification Search
CPC .... F28F 1/325; F28F 1/022; F28F 1/14; F28F 1/16; F28F 1/128; F28F 1/30;
(Continued)

(56) References Cited

U.S. PATENT DOCUMENTS

2013/0206376 A1* 8/2013 Shikazono ..... F28D 1/0316 165/172
2018/0100659 A1 4/2018 Yoshimura et al.
2019/0033017 A1 1/2019 Abastari

FOREIGN PATENT DOCUMENTS

CN 107407534 A 11/2017
EP 2980516 A1 2/2016
(Continued)

OTHER PUBLICATIONS

Pdf file is translation of foreign reference WO 2017017789 A1 (Year: 2017).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A heat exchanger, a heat exchanger unit, and a refrigeration cycle apparatus in which frost melt water is inhibited from reaching an upper surface of a header include: heat transfer tubes arranged in parallel with each other; a fin connected to one of the heat transfer tubes; and a header connected to the heat transfer tubes and having a header end surface along a direction in which the heat transfer tubes are arranged in parallel. The fin has an edge facing the header and extends in a first direction perpendicular to the axes of the heat transfer tubes. An end portion of the fin projects in the first direction relative to the header end surface, and another end
(Continued)

portion of the fin in the first direction is positioned closer in the first direction to the heat transfer tubes than the header end surface is.

14 Claims, 9 Drawing Sheets

(51) Int. Cl.
*F28D 21/00* (2006.01)
*F28F 1/12* (2006.01)
*F28F 1/30* (2006.01)
*F28F 9/02* (2006.01)

(52) U.S. Cl.
CPC ..... *F28F 1/128* (2013.01); *F28F 1/30* (2013.01); *F28F 2009/0285* (2013.01)

(58) Field of Classification Search
CPC ..... F28F 2009/0285; F25B 39/02; F28D 2021/0068; F28D 1/0478; F28D 1/05366
See application file for complete search history.

(56) References Cited

FOREIGN PATENT DOCUMENTS

| | | | | |
|---|---|---|---|---|
| EP | 3156752 | A1 | 4/2017 | |
| JP | 2016-170601 | A | 9/2016 | |
| WO | 2014/155560 | A1 | 10/2014 | |
| WO | 2015/189990 | A1 | 12/2015 | |
| WO | 2017017789 | A1 | 2/2017 | |
| WO | WO-2017017789 | A1 * | 2/2017 | ..... F28F 1/30 |
| WO | 2017168669 | A1 | 10/2017 | |

OTHER PUBLICATIONS

Attached pdf is translation of foreign reference WO 2017017789 (Year: 2017).*
International Search Report of the International Searching Authority dated Oct. 2, 2018 for the corresponding International application No. PCT/JP2018/026186 (and English translation).
Examination Report dated Apr. 30, 2021, issued in corresponding IN Patent Application No. 202027051832 (and English Machine Translation).

* cited by examiner

HEAT EXCHANGER, HEAT EXCHANGER UNIT, AND REFRIGERATION CYCLE APPARATUS

CROSS REFERENCE TO RELATED APPLICATION

This application is a U.S. national stage application of International Application No. PCT/JP2018/026186 filed on Jul. 11, 2018, the contents of which are incorporated herein by reference.

TECHNICAL FIELD

The present disclosure relates to a heat exchanger, a heat exchanger unit including the heat exchanger, and a refrigeration cycle apparatus, and, in particular, to a structure of a fin attached to a heat transfer tube.

BACKGROUND ART

There have been known heat exchangers including flat tubes that are heat transfer tubes whose sections each have a flat shape and a plurality of holes to improve heat exchange performance. Such a heat exchanger in which a plurality of flat tubes are arranged in parallel with each other such that their longitudinal tube axes are along the direction of gravity includes a header that distributes or collects fluid to be subjected to heat exchange at lower end portions in the direction of gravity of the flat tubes. In such a heat exchanger, frost melt water on surfaces of the flat tubes or fins is discharged in the direction of gravity along the flat tubes or the fins. For this reason, water easily remains on an upper surface of the header, in particular, joints between the header and the flat tubes, and easily remains between the upper surface of the header and the fins. There has been known a heat exchanger in which an upper surface of a header is inclined in the direction of gravity to facilitate discharge of frost melt water from the upper surface of the header (for example, see Patent Literature 1).

CITATION LIST

Patent Literature

Patent Literature 1: International Publication No. 2015/189990

SUMMARY OF INVENTION

Technical Problem

However, in the existing heat exchanger described in Patent Literature 1, water easily remains on joints between flat tubes and the header, and in a space between fins and the header due to surface tension. In particular, the water remaining on the upper surface of the header freezes under conditions in which the heat exchanger is exposed to low-temperature air. Thus, there is a problem in that discharge of the water reaching the upper surface of the header from an upper portion of the heat exchanger is obstructed and this causes a frozen part to be further expanded. The expansion of the frozen part causes problems in the heat exchanger in that the heat exchange performance is impaired and the reliability is reduced due to damage of the flat tubes, the fins, or a header tank.

The heat exchanger of the present disclosure is made to overcome such problems, and aims to provide a heat exchanger, a heat exchanger unit, and a refrigeration cycle apparatus in which frost melt water is inhibited from reaching an upper surface of a header and the heat exchange performance and the reliability are improved.

Solution to Problem

A heat exchanger according to an embodiment of the present disclosure includes: a plurality of heat transfer tubes arranged in parallel with each other; a fin connected to at least one of the plurality of heat transfer tubes; a header having a header end surface being a surface along a direction in which the plurality of heat transfer tubes are arranged in parallel with each other, the header being connected to one end portions of the plurality of heat transfer tubes, the fin having a first portion including an edge facing the header and a second portion other than the first portion, the fin extending in a first direction crossing the direction in which the plurality of heat transfer tubes are arranged in parallel with each other, the first direction being perpendicular to a tube axis of each of the plurality of heat transfer tubes, wherein an end portion in the first direction of the first portion projects in the first direction relative to the header end surface, and an end portion in the first direction of the second portion is positioned closer in the first direction to the plurality of heat transfer tubes than the header end surface is to the plurality of heat transfer tubes.

A heat exchanger unit according to another embodiment of the present disclosure includes the heat exchanger.

A refrigeration cycle apparatus according to still another embodiment of the present disclosure includes the heat exchanger unit.

Advantageous Effects of Invention

According to an embodiment of the present disclosure, the heat exchanger can be improved in both heat exchange performance and reliability by reducing the amount of water flowing onto an upper surface of the header and by inhibiting a frozen part of the upper surface of the header from expanding.

DESCRIPTION OF EMBODIMENTS

Figure 1:
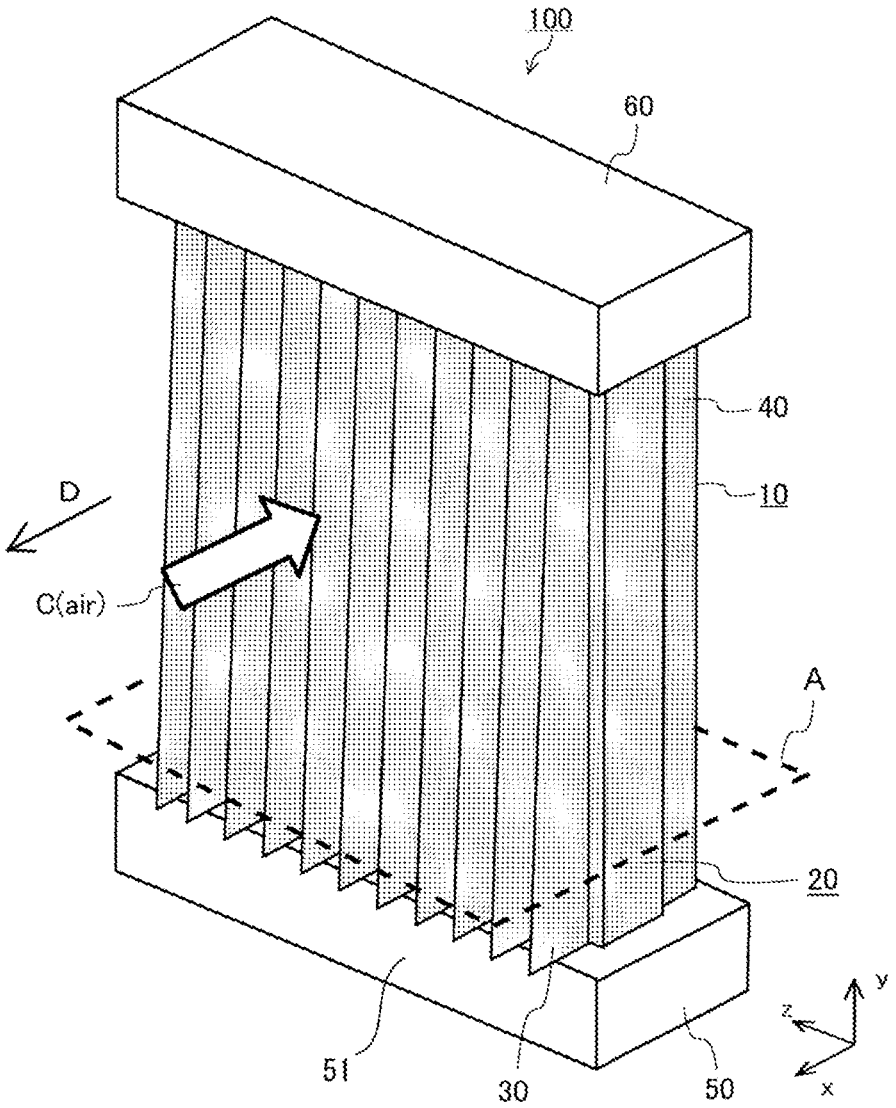
FIG. 1 is a perspective view illustrating a heat exchanger according to Embodiment 1.

Embodiments of a heat exchanger and a heat exchanger unit are described below. The forms in the drawings are examples, and the present disclosure is not limited thereby. In the drawings, components having the same reference signs are the same or corresponding components, and this applies to the entire description. In addition, the size relationships of the components in the drawings below may differ from those of actual ones.

Embodiment 1

Figure 2:
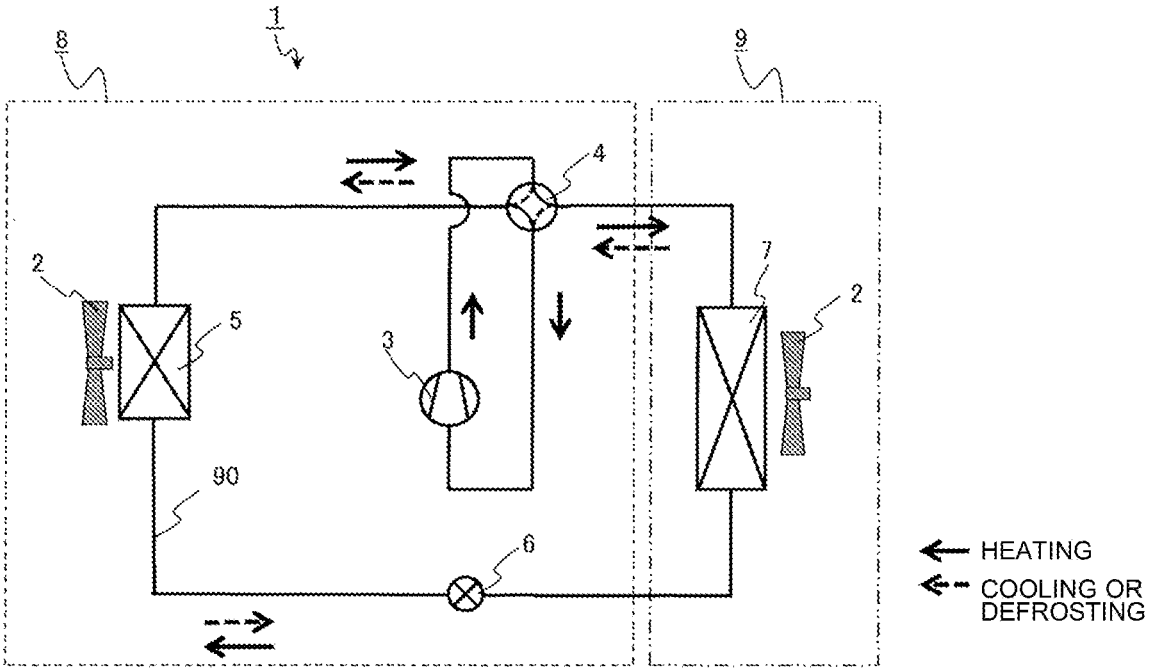
FIG. 2 is a diagram of a refrigeration cycle apparatus to which the heat exchanger according to Embodiment 1 is applied.

FIG. 1 is a perspective view illustrating a heat exchanger 100 according to Embodiment 1. FIG. 2 is a diagram of a refrigeration cycle apparatus 1, to which the heat exchanger 100 according to Embodiment 1 is applied. The heat exchanger 100 illustrated in FIG. 1 is accommodated in the refrigeration cycle apparatus 1, such as an air-conditioning apparatus or a refrigerator. In the refrigeration cycle apparatus 1, a compressor 3, a four-way valve 4, an outdoor heat exchanger 5, an expansion device 6, and an indoor heat exchanger 7 are connected by a refrigerant pipe 90 and form a refrigerant circuit. For example, when the refrigeration cycle apparatus 1 is an air-conditioning apparatus, refrigerant flows through the refrigerant pipe 90, and a heating operation, a cooling operation, and a defrosting operation can be switched by switching refrigerant flows with the four-way valve 4.

The outdoor heat exchanger 5 accommodated in an outdoor unit 8 and the indoor heat exchanger 7 accommodated in an indoor unit 9 are provided with respective fans 2 near the outdoor heat exchanger 5 and the indoor heat exchanger 7. The fan 2 in the outdoor unit 8 sends the outside air into the outdoor heat exchanger 5, and the outdoor heat exchanger 5 exchanges heat between the outside air and refrigerant. The fan 2 in the indoor unit 9 sends indoor air into the indoor heat exchanger 7, and the indoor heat exchanger 7 exchanges heat between the indoor air and refrigerant and conditions indoor air temperature. The heat exchanger 100 can be used as the outdoor heat exchanger 5 accommodated in the outdoor unit 8 and the indoor heat exchanger 7 accommodated in the indoor unit 9 in the refrigeration cycle apparatus 1. The heat exchanger 100 functions as a condenser or an evaporator. Devices such as the outdoor unit 8 and the indoor unit 9, in which the heat exchanger 100 is accommodated, are specifically referred to as heat exchanger units.

The heat exchanger 100 illustrated in FIG. 1 includes a heat exchange unit 10, a lower end header 50, which is disposed at one end portion of the heat exchange unit 10, and an upper end header 60, which is disposed at the other end portion of the heat exchange unit 10. The lower end header 50 and the upper end header 60 are connected to the refrigerant pipe 90, which connects the devices forming the refrigeration cycle apparatus 1 illustrated in FIG. 2. For example, refrigerant flows into the upper end header 60 and is distributed to heat transfer tubes 21, which form the heat exchange unit 10, from the upper end header 60. The refrigerant passing through the heat transfer tubes 21 is collected in the lower end header 50 again and flows into the refrigerant pipe 90.

Figure 3:
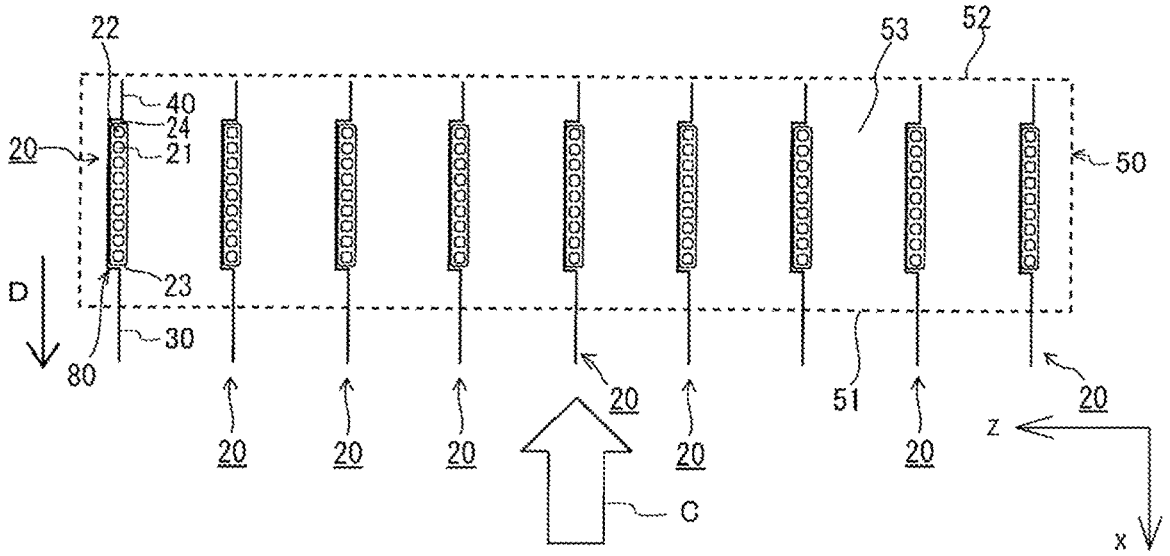
FIG. 3 is a diagram illustrating a sectional structure of a heat exchange unit of the heat exchanger in FIG. 1.
Figure 4:
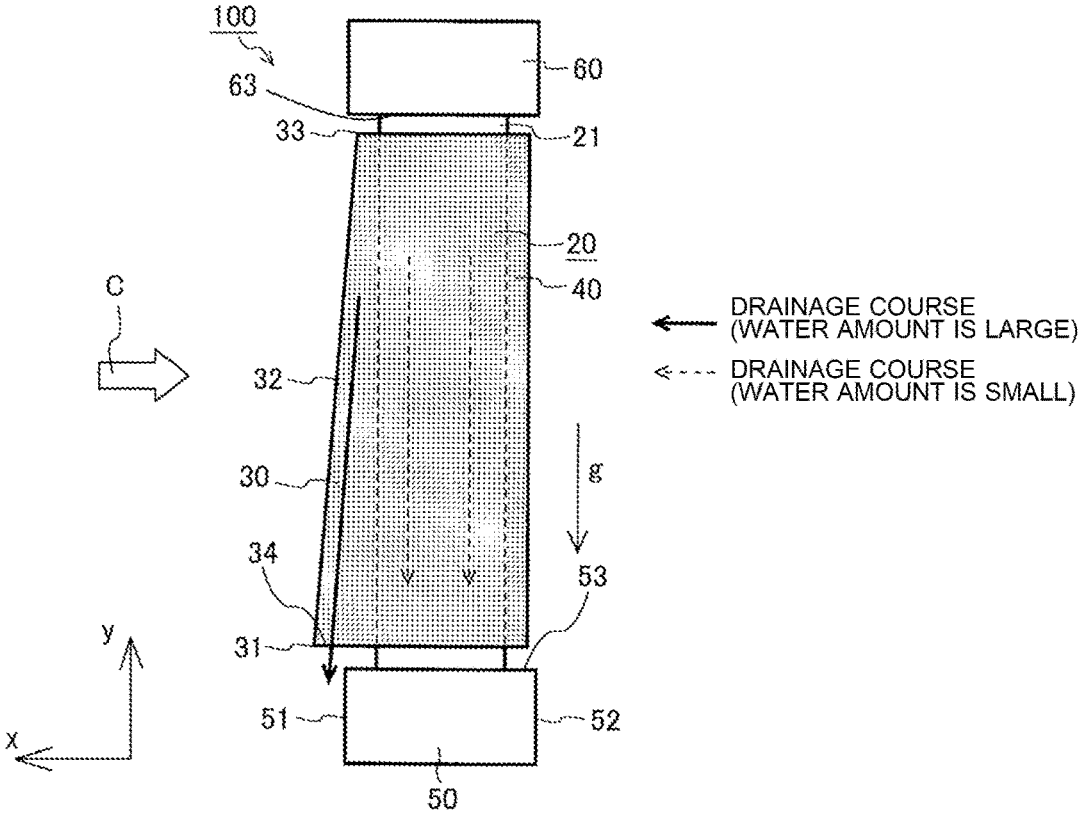
FIG. 4 is a side view of the heat exchanger in FIG. 1.

FIG. 3 is a diagram illustrating a sectional structure of the heat exchange unit 10 of the heat exchanger 100 in FIG. 1. FIG. 4 is a side view of the heat exchanger 100 in FIG. 1. FIG. 3 is a top view of a structure of the heat exchange unit 10 taken along a section A, which is positioned in the middle in the y direction in FIG. 1. The x direction, the y direction, and the z direction in the drawings are directions common to each drawing. The heat exchange unit 10 is formed by the heat transfer tubes 21 arranged in parallel with each other in the z direction such that their longitudinal tube axes are along the y direction. In Embodiment 1, specifically, the heat transfer tubes 21 are formed by flat tubes. The axis in the longitudinal direction of a section perpendicular to the longitudinal tube axis of each of the heat transfer tubes 21 is referred to as a major axis, and the axis in the direction perpendicular to the major axis is referred to as a minor axis. The major axis of each of the heat transfer tubes 21 is along the x direction. The heat exchanger 100 is a heat exchanger formed by the heat transfer tubes 21, which are formed by flat tubes, arranged in parallel with each other such that their major axes are parallel with each other. The lower end header 50 is connected to one end of each of the heat transfer tubes 21, and the upper end header 60 is connected to the other end. The lower end header 50 and the upper end header 60 are disposed in parallel with each other. When the heat exchanger 100 is accommodated in a heat exchanger unit such as the outdoor unit 8 forming the refrigeration cycle apparatus 1, the heat exchanger 100 is disposed such that the upper end header 60 is positioned above the lower end header 50. Broken lines illustrated in FIG. 3 represent the outline of the lower end header 50. The lower end header 50 is disposed such that a header end surface 51 faces in a first direction D. In Embodiment 1, the heat exchanger 100 is disposed such that the longitudinal tube axis of each of the heat transfer tubes 21 is along the direction of gravity. However, the longitudinal tube axis of each of the heat transfer tubes 21 is not limited only to that along the direction of gravity. It is only required that the lower end header 50 be positioned below the upper end header 60. For example, in a heat exchanger unit, the heat exchanger 100 may be disposed such that the longitudinal tube axis of each of the heat transfer tubes 21 is inclined relative to the direction of gravity.

The heat transfer tubes 21 each have a flat shape and a section perpendicular to the longitudinal tube axis having a major axis and a minor axis. A plurality of refrigerant passages 22, through which refrigerant flows, are disposed in each of the heat transfer tubes 21. The refrigerant passages 22 are arranged from one end portion 23 of the major axis of each of the heat transfer tubes 21 toward the other end portion 24. The heat transfer tubes 21 are made of metal material having thermal conductivity. For example, aluminum, aluminum alloy, copper, or copper alloy is used as the material for forming the heat transfer tubes 21. The heat transfer tubes 21 are produced by an extrusion process in which the section illustrated in FIG. 3 is formed by extruding heated material from die holes. The heat transfer tubes 21 may be produced by a drawing process in which the section illustrated in FIG. 3 is formed by drawing material from die holes. The method for producing the heat transfer tubes 21 can be selected as appropriate according to the sectional shapes of the heat transfer tubes 21.

Fins 30 and 40 are connected the respective heat transfer tubes 21. Each of the fins 30 extends in the x direction from the one end portion 23 of the major axis of the corresponding heat transfer tube 21, which is a flat tube. That is, each of the fins 30 extends in the direction that is perpendicular to the longitudinal tube axis of each of the heat transfer tubes 21 and that crosses the direction in which the heat transfer tubes 21 are arranged in parallel with each other. In the description, the direction in which the fins 30 extend from the end portions 23 of the heat transfer tubes 21 is referred to as the first direction D. In Embodiment 1, each of the fins 30 extends along the major axis of a section of the corresponding heat transfer tube 21, which is a flat tube. Each of the fins 40 extends, from the other end portion 24 of the corresponding heat transfer tube 21, which is a flat tube, in the direction opposite to the direction in which the fins 30 extend. The directions in which the fins 30 and 40 extend are not limited only to the x direction illustrated in FIG. 3 and may be inclined relative to the x direction. That is, the fins 30 and 40 may extend to be inclined in the direction inclined relative to the major axes of sections of the heat transfer tubes 21.

As illustrated in FIG. 3, the fins 30 and 40 may be formed by bending respective single plate-like parts 80. In Embodiment 1, each of the plate-like parts 80 is formed into a shape following the sectional shape of the corresponding heat transfer tube 21 such that the heat transfer tube 21 is fit to the shape of the plate-like part 80. In addition, each of the plate-like parts 80 is formed such that the corresponding fins 30 and 40 extend in the x direction from the respective end portions of a recessed portion to which the heat transfer tube 21 is fit. The heat exchange unit 10 is formed by attaching and joining, with a joining method such as brazing, the plate-like parts 80 having the sectional shape to the respective heat transfer tubes 21. The shape of the plate-like parts 80 is not limited only to the shape illustrated in FIG. 3 and may be, for example, a simple flat shape.

In Embodiment 1, a heat transfer tube unit 20 is composed of the heat transfer tube 21 and the fins 30 and 40 (plate-like part 80). As illustrated in FIG. 3, a plurality of heat transfer tube units 20 are disposed in the z direction with spaces therebetween. The heat transfer tube units 20 adjacent to each other are connected only by the lower end header 50 and the upper end header 60. That is, the heat exchange unit 10 does not include a component that connects the heat transfer tube units 20 between an upper surface 53 of the lower end header 50 and a lower surface 63 of the upper end header 60. The heat transfer tube unit 20 may be composed of the heat transfer tube 21 and the fin 30. That is, the fin 40 does not have to be disposed in the heat transfer tube unit 20. In addition, the fins 30 and 40 do not have to be disposed on all the heat transfer tubes 21 in the heat exchange unit 10. That is, it is only required that the heat exchange unit 10 include at least one of the heat transfer tube units 20.

As illustrated in FIG. 4, an end of the fin 30 projects in the x direction relative to the header end surface 51, which is one end surface of the lower end header 50. In Embodiment 1, the header end surface 51 is an end surface that faces in the x direction of the lower end header 50 and that is along the z direction, in which the heat transfer tubes 21 are arranged in parallel with each other. An end portion of a first portion of the fin 30, the first portion being a part of the fin 30 and including an edge 34 facing the lower end header 50 of the fin 30, projects in the x direction relative to the header end surface 51. In particular, an end 31, which is positioned closer to the lower end header 50, of an end edge 32, which is positioned at an end of the fin 30 in the first direction, projects in the x direction relative to the header end surface 51, which is one end surface of the lower end header 50. An end 33, which is positioned closer to the upper end header 60, of the end edge 32 is positioned closer to the heat transfer tube 21 than the header end surface 51, which is one end surface of the lower end header 50, is. Thus, the header 50 does not exist under the end 31 of the fin 30. The end edge 32 is formed by a straight line inclined relative to the longitudinal tube axis of the heat transfer tube 21 from the end 33 closer to the upper end header 60 toward the end 31 closer to the lower end header 50. That is, the end edge 32 is inclined relative to the direction of gravity. An arrow g illustrated in FIG. 4 represents the direction of gravity.

The heat exchanger 100 according to Embodiment 1 is disposed such that the end edges 32 of the fins 30 face windward. As illustrated in FIGS. 1, 3, and 4, air flows into the heat exchanger 100 in the direction of an arrow C. That is, when the heat exchanger 100 is disposed as, for example, the outdoor heat exchanger 5 in the refrigeration cycle apparatus 1, the fan 2 operates to cause the outside air to flow into between the fins 30 of the heat exchanger 100 and pass through spaces formed by the heat transfer tube units 20.

Effects of Embodiment 1

Effects of the heat exchanger 100 according to Embodiment 1 are described. To make a drainage-facilitating effect of the heat exchanger 100 according to Embodiment 1 easy to understand, operation of the heat exchanger 100 functioning as an evaporator under a low-temperature outside air condition is described below. Subsequently, the configuration of a heat exchanger 1100 in a comparative example is described, and the drainage-facilitating effect of the heat exchanger 100 according to Embodiment 1 is then described.

In the description of the comparative example, each of the components in the comparative example is assigned a reference numeral that is determined by adding 1000 to the value of a reference numeral of a corresponding one of the components in Embodiment 1. For example, the heat exchanger in the comparative example is represented as the heat exchanger 1100. In the description of the heat exchanger 1100 in the comparative example, the components that are the same as those of the heat exchanger 100 according to Embodiment 1 have the same reference signs.

When the refrigeration cycle apparatus 1 operates and the heat exchanger 100 functions as an evaporator, low-temperature refrigerant flows through the refrigerant passages 22 of the heat transfer tubes 21. When the refrigerant temperature is 0 degrees C. or less, the moisture in the air sent into the heat exchanger 100 changes into frost on surfaces of the heat transfer tube units 20, and the frost adheres to the surfaces of the heat transfer tube units 20. In this case, the refrigeration cycle apparatus 1 typically performs the defrosting operation after a normal operation, and the frost adhering to the surfaces of the heat transfer tube units 20 is removed. The defrosting operation is an operation in which high-temperature refrigerant flows through the refrigerant passages 22 to melt the frost adhering to the heat transfer tube units 20. As a result of this operation, frost melt water is generated on the surfaces of the heat transfer tube units 20.

Figure 5:
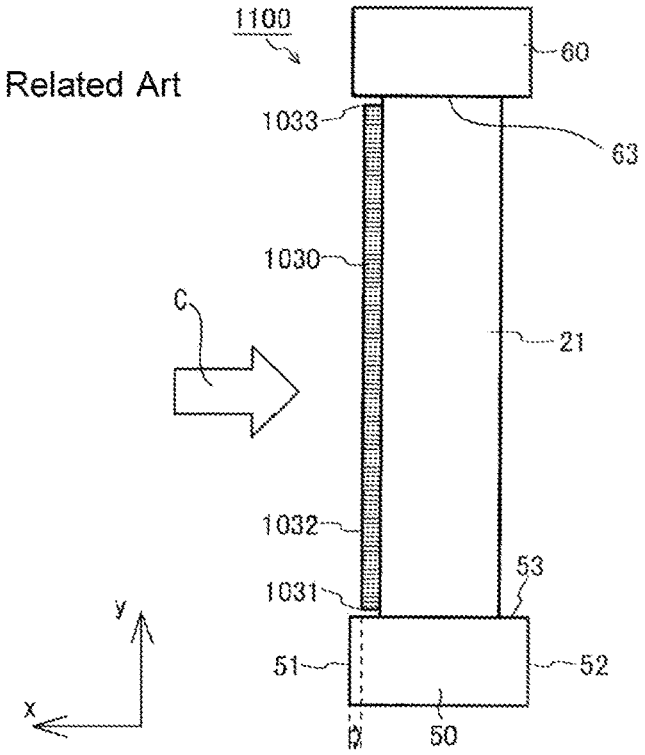
FIG. 5 is a side view illustrating a heat exchanger as a comparative example of the heat exchanger according to Embodiment 1.

FIG. 5 is a side view illustrating the heat exchanger 1100 as the comparative example of the heat exchanger 100 according to Embodiment 1. Unlike the heat exchanger 100 according to Embodiment 1, in the heat exchanger 1100 as the comparative example, an end edge 1032 of a fin 1030 is positioned closer in the x direction to the heat transfer tube 21 than the header end surface 51 of the lower end header 50 is. Typically, the amount of frost generated is large on the windward side in a heat exchanger, on which the temperature difference between air and refrigerant flowing through the heat transfer tubes 21 is large. Similarly to the fin 30 of the heat exchanger 100 according to Embodiment 1, in the heat exchanger 1100 in the comparative example, the fin 1030 extends to the windward. Thus, a large amount of frost is generated on the fin 1030. In the heat exchanger 1100 in the comparative example, when frost melt water is drained downward due to gravity, all of the frost melt water reaches the upper surface 53 of the lower end header 50, and some of the frost melt water remains near the heat transfer tube 21 and the fin 1030. In particular, due to surface tension of melt water, the melt water remains on the boundary portion between the heat transfer tube 21 and the upper surface of the lower end header 50, and in a space between the fin 1030 and the upper surface of the lower end header 50. The melt water remaining on the upper surface of the lower end header 50 freezes under a low-temperature outside air condition, and thus a frozen part is expanded from the frozen melt water. For this reason, in the heat exchanger 1100 in the comparative example, spaces between the fins 1030 and spaces between the heat transfer tubes 21 are blocked. As a result, the heat exchange performance is impaired, and the reliability is reduced due to damage of the heat transfer tubes 21, the fins 1030, and the lower end header 50.

On the other hand, in the heat exchanger 100 according to Embodiment 1, on the windward side, on which frost is intensively generated, the end 31 closer to the lower end header 50 of the fin 30 projects to the windward relative to the header end surface 51 of the lower end header 50. In other words, the end portion of the part including the edge 34 facing the header of the fin 30 projects in the x direction relative to the header end surface 51. The part including the edge 34 facing the header of the fin 30 is specifically referred to as the first portion. Since the end portion of the first portion projects in the x direction relative to the header end surface 51, as illustrated in FIG. 4, most of the melt water is discharged to the outside of the heat exchanger 100 without reaching the lower end header 50. In particular, in the heat exchanger 100, frost is intensively generated on the fin 30, which is positioned on the windward side. Thus, since the end 31 closer to the lower end header 50 of the fin 30 projects in the x direction relative to the header end surface 51 of the lower end header 50, frost melt water generated on the fin 30 moves along the fin 30 and drops from the edge 34 facing the header of the fin 30. Thus, the melt water remaining in a space between the fin 30 and the edge 34 facing the header and the melt water that moves along the heat transfer tube 21 and reaches the upper surface 53 of the lower end header 50 are reduced. As a result, it is possible to inhibit freezing of the upper surface 53 of the lower end header 50 from progressing and a frozen part of the upper surface 53 of the lower end header 50 from expanding. Accordingly, it is possible to reduce impairment of the heat exchange performance and to improve the reliability.

Modifications of Embodiment 1

FIGS. 6 to 9 are side views illustrating modifications of the heat exchanger 100 according to Embodiment 1. Similarly to FIG. 4, FIGS. 6 to 9 illustrate the heat exchanger 100 when viewed in the z direction in FIG. 1. The shape of the fin 30 of the heat exchanger 100 according to Embodiment 1 is not limited to the shape illustrated in FIG. 4. The fin 30 may have any shape as long as the first portion that is the part of the fin 30 and that includes the edge 34 facing the header projects in the x direction relative to the header end surface 51 of the lower end header 50.

Figure 6:
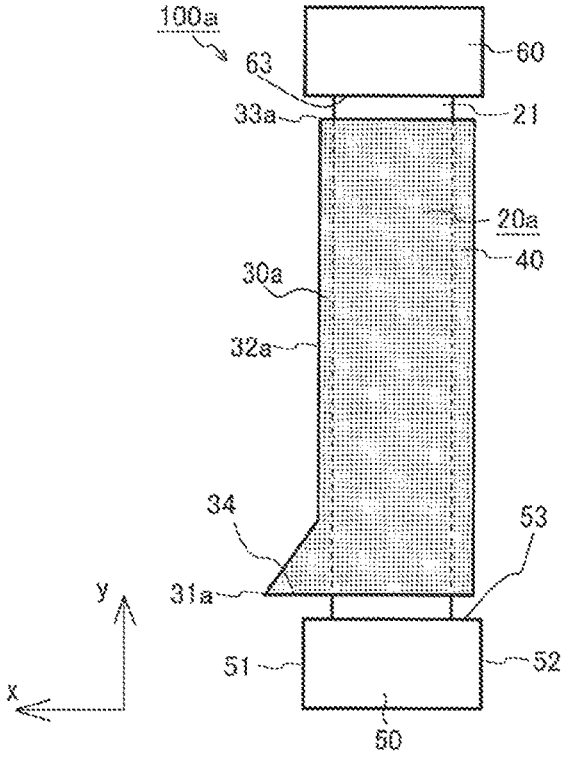
FIG. 6 is a side view illustrating a modification of the heat exchanger according to Embodiment 1.

As illustrated in FIG. 6, a heat transfer tube unit 20*a* is formed by connecting a fin 30*a* and the fin 40 to the heat transfer tube 21 of a heat exchanger 100*a*. A region closer to the upper end header 60 of the fin 30*a* of the heat exchanger 100*a* is positioned closer to the heat transfer tube 21 than the header end surface 51 of the lower end header 50 is. Only a part closer to the lower end header 50 including an end 31*a* closer to the lower end header of the fin 30*a* of the heat exchanger 100*a* projects in the x direction relative to the header end surface 51. A part closer to the upper end header 60 of an end edge 32*a* of the fin 30*a* is formed by a straight line parallel with the longitudinal tube axis of the heat transfer tube 21. The part other than the part closer to the upper end header 60 of the end edge 32*a* is inclined, in the x direction, away from the heat transfer tube 21 to the end 31*a* closer to the lower end header 50. The heat exchanger 100*a* is formed as described above, and thus the frost melt water generated on a part closer to the upper end header 60 flows down along the end edge 32*a* of the fin 30*a* and is guided to a position outside the upper surface 53 of the lower end header 50. Frost melt water flows down from an upper portion of the fin 30*a*, and thus a large amount of water adheres to a region closer to the lower end header 50 of the fin 30*a*. However, the region closer to the lower end header 50 of the fin 30*a* is large. Thus, it is possible to inhibit water from flowing from the fin 30*a* toward the heat transfer tube 21 and from remaining on the upper surface 53 of the lower end header 50.

Figure 7:
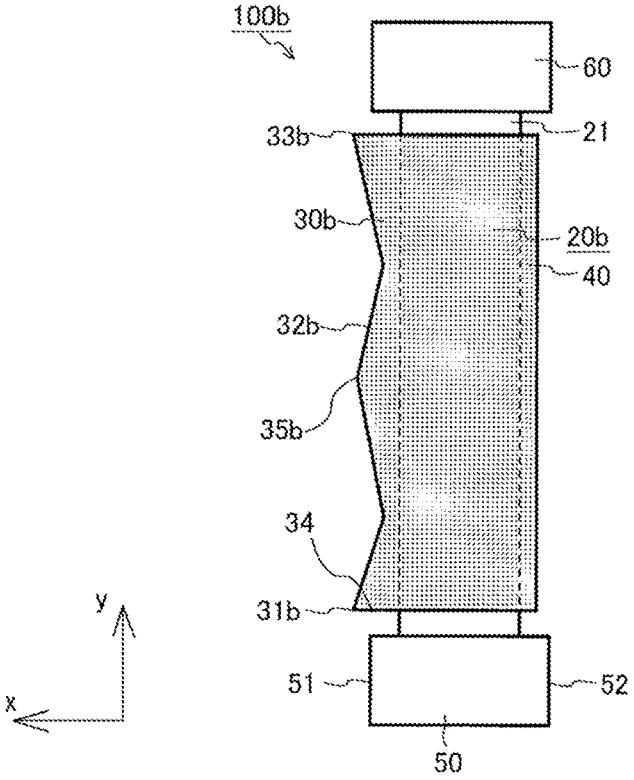
FIG. 7 is a side view illustrating a modification of the heat exchanger according to Embodiment 1.

As illustrated in FIG. 7, a heat transfer tube unit 20*b* is formed by connecting a fin 30*b* and the fin 40 to the heat transfer tube 21 of a heat exchanger 100*b*. In the fin 30*b* of the heat exchanger 100*b*, an end 31*b* closer to the lower end header 50, an end 33*b* closer to the upper end header 60, and a center 35*b* of an end edge 32*b* of the fin 30*b* project relative to the header end surface 51 of the lower end header 50. A part of the end edge 32*b* of the fin 30*b* between the end 31*b* closer to the lower end header and the center 35*b* and a part of the end edge 32*b* of the fin 30*b* between the end 33*b* closer to the upper end header and the center 35*b* are positioned closer to the heat transfer tube 21 than the header end surface 51 of the lower end header 50 is. The heat exchanger 100*b* is formed as described above, and thus frost melt water can be discharged from the end 31*b* closer to the lower end header 50 with the amount of frost generated on the fin 30*b* equalized from a part closer to the upper end header 60 of the fin 30*b* to a part closer to the lower end header 50 of the fin 30*b*.

For example, when the heat exchanger 100*b* is disposed in a heat exchanger unit, and the fan 2 configured to send air into the heat exchanger 100*b* is a propeller fan, the amount of projection, from the heat transfer tube 21, of parts of the fin 30*b* where the flow velocity of air passing through the heat exchanger 100*b* is high is set to be large. On the other hand, the amount of projection, from the heat transfer tube 21, of parts of the fin 30*b* where the flow velocity of air passing through the heat exchanger 100*b* is low is set to be relatively small. The parts of the fin 30*b* whose amount of projection from the heat transfer tube 21 is large have lower conductivity of cooling energy from the heat transfer tube 21 than that of the parts of the fin 30*b* whose amount of projection from the heat transfer tube 21 is small. For this reason, the amount of frost generated on the end edge 32 of the fin 30*b* can be reduced. Thus, the amount of frost generated on the fin 30*b* can be controlled by increasing the amount of projection, from the heat transfer tube 21, of the parts of the fin 30*b* where the amount of air sent into the heat exchanger 100*b* is large, that is, the parts of the fin 30*b* where the flow velocity of air passing through the heat exchanger 100*b* is high.

Figure 8:
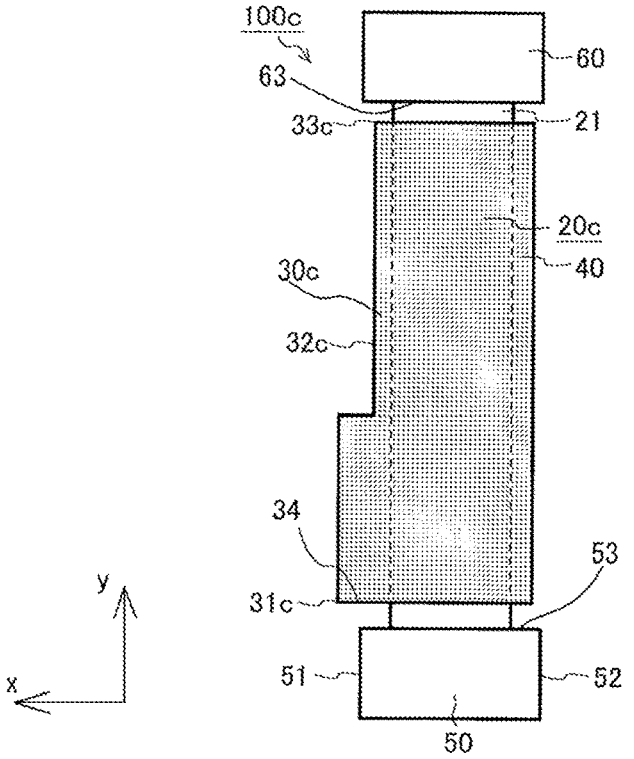
FIG. 8 is a side view illustrating a modification of the heat exchanger according to Embodiment 1.

As illustrated in FIG. 8, a heat transfer tube unit 20*c* is formed by connecting a fin 30*c* and the fin 40 to the heat transfer tube 21 of a heat exchanger 100*c*. A region closer to the upper end header 60 of the fin 30*c* of the heat exchanger 100*c* is positioned closer to the heat transfer tube 21 than the header end surface 51 of the lower end header 50 is. Only a part closer to the lower end header 50 including an end 31*c* closer to the lower end header 50 of the fin 30*c* projects in the x direction relative to the header end surface 51. Unlike the heat exchanger 100*a* illustrated in FIG. 6, a part closer to the lower end header 50 of an end edge 32*c* of the fin 30*c* is not inclined but is parallel with the longitudinal tube axis of the heat transfer tube 21. Thus, the size of the part closer to the lower end header 50 of the fin 30*c*, to which the amount of adhering frost melt water is large, is large. As a result, melt water can be efficiently discharged without the water flowing toward the heat transfer tube 21.

The shapes of the fins 30 and 30*a* to 30*c* of the heat exchangers 100 and 100*a* to 100*c* are not limited to the shapes illustrated in FIGS. 4 and 6 to 8 and can be modified as appropriate according to the flow velocity of air passing through the heat exchangers 100 and 100*a* to 100*c*. That is, in the shapes of the fins 30 and 30*a* to 30*c* of the heat exchangers 100 and 100*a* to 100*c*, the end portion of the first portion including the edge 34 facing the header positioned at an end closer to the lower end header of each of the fins 30 and 30*a* to 30*c* projects in the x direction relative to the header end surface 51. An end portion of a second portion that is a part other than the first portion of each of the fins 30 and 30*a* to 30*c* is formed to be positioned closer to the heat transfer tube 21 than the header end surface 51 is.

Figure 9:
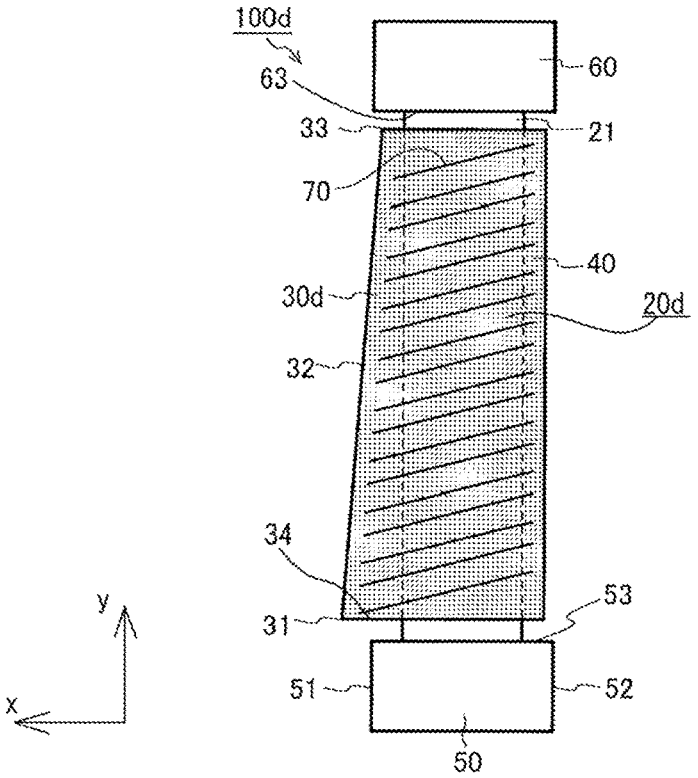
FIG. 9 is a side view illustrating a modification of the heat exchanger according to Embodiment 1.

As illustrated in FIG. 9, a heat transfer tube unit 20*d* is formed by connecting a fin 30*d* and the fin 40 to the heat transfer tube 21 of a heat exchanger 100*d*. Water guides are disposed on the heat transfer tube unit 20*d* of the heat exchanger 100*d*. For example, water guides 70 may be disposed on the plate-like part 80 forming the fins 30 and 40. Alternatively, the water guides 70 may be disposed on the heat transfer tube 21 forming the heat transfer tube unit 20*d*. The water guides 70 may be, for example, a louver disposed on the plate-like part 80 having a flat shape, grooves and projections disposed on the plate-like part 80, or dimples. The water guides 70 of the heat exchanger 100*d* are disposed to be inclined to approach the lower end header 50 toward the end edge 32 of the fin 30, and water droplets closer to the heat transfer tube 21 can be guided toward the end edge 32 of the fin 30. Thus, water droplets adhering to a part closer to the heat transfer tube 21 do not directly flow onto the upper surface of the lower end header 50 but can move toward the end edge 32 of the fin 30 and then flow down. In addition, since the water guides 70 are inclined to approach the lower end header 50 toward the end edge 32 of the fin 30, the ease of drainage is improved. As a result, it is possible to inhibit freezing of the upper surface 53 of the lower end header 50 from progressing and a frozen part of the upper surface 53 of the lower end header 50 from expanding. Accordingly, it is possible to reduce impairment of the heat exchange performance and to improve the reliability.

In Embodiment 1, although the heat transfer tubes 21 are flat tubes, the heat transfer tubes 21 may be heat transfer tubes whose sections each have a round shape. However, when the heat transfer tubes 21 are flat tubes, it is advantageous to employ configurations such as those of the heat exchangers 100 and 100*a* to 100*d* according to Embodiment 1 because the longitudinal tube axis of each of the heat transfer tubes 21 is often along the direction of gravity to facilitate downward flow of the water adhering to surfaces of the flat tubes.

The fins 30 are made of a plate-like metal material having thermal conductivity. For example, aluminum, aluminum alloy, copper, or copper alloy is used as the material for forming the fins 30.

Embodiment 2

In a heat exchanger 200 according to Embodiment 2, the direction in which the fin 30 projects relative to the lower end header 50 is changed from that in the heat exchanger 100 according to Embodiment 1. In other words, the positional relationship between the heat exchanger 100 and the fan 2 in a heat exchanger unit is reversed with that in Embodiment 1. The heat exchanger 200 according to Embodiment 2 is described with the focus on the differences between Embodiment 1 and Embodiment 2. The parts of the heat exchanger 200 according to Embodiment 2 having the same functions in the drawings are represented to have the same reference signs as those in the drawings used in the description of Embodiment 1.

Figure 10:
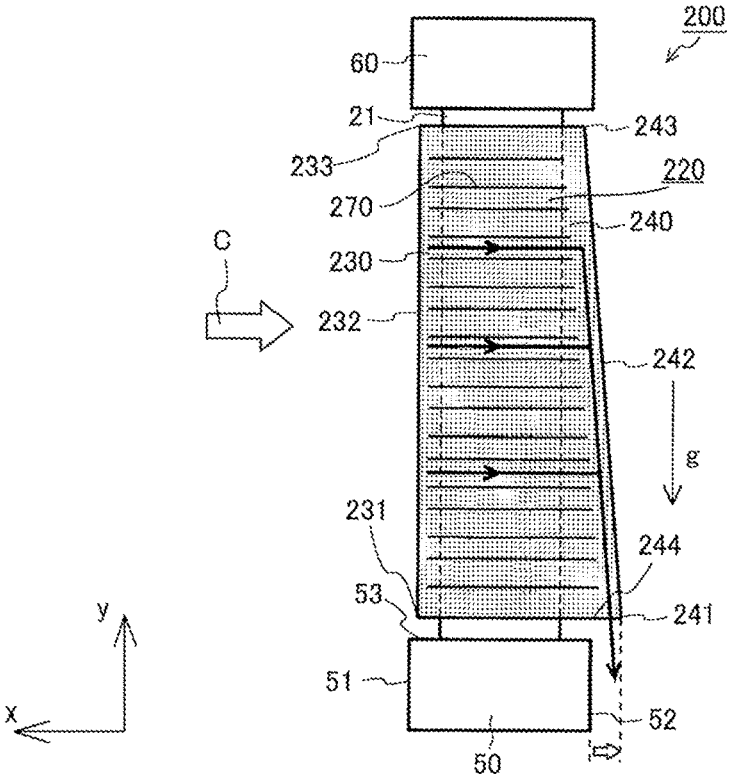
FIG. 10 is a side view of a heat exchanger according to Embodiment 2.

FIG. 10 is a side view of the heat exchanger 200 according to Embodiment 2. The differences between the heat exchanger 200 according to Embodiment 2 and the heat exchanger 100 according to Embodiment 1 are as follows. A heat transfer tube unit 220 is formed by connecting a fin 230 and a fin 240 to the heat transfer tube 21 of the heat exchanger 200. The entire fin 230, which is disposed on the windward side, is positioned closer to the heat transfer tube 21 than the header end surface 51 is. An end 241 of a part including an edge 244 facing the header of the fin 240, which is disposed on the leeward side, projects relative to a header end surface 52. That is, this configuration is similar to the configuration in which the end edge 32 of the fin 30 of the heat exchanger 100 according to Embodiment 1 faces leeward.

Water guides 270, such as grooves and projections or a louver, are formed on surfaces of the fins 230 and 240 of the heat exchanger 200. Preferably, the water guides 270 are formed such that their edge lines are along the x direction, or are formed to be inclined, in the direction of gravity, from the fin 240 on the windward side toward the fin 240 on the leeward side.

Effects of Embodiment 2

In the heat exchanger 200 according to Embodiment 2, when the heat exchanger 200 operates as an evaporator, the frost melt water intensively generated on the windward side of the fin 230 is moved along the water guides 270 and is guided toward an end edge 242 of the fin 240 by the air sent by the fan 2. The water guides 270 are each formed along the x direction and are arranged on the heat transfer tube 21 in the y direction. The water guides 270 are each disposed with a space between an end portion thereof and the end edge 242. For this reason, frost melt water is moved toward the fin 240 by airflow. The frost melt water reaching the vicinity of the end edge 242 of the fin 240 flows down along the end edge 242 and is then discharged below the edge 244 facing the header. Thus, the frost melt water adhering to the fins 230 and 240 is discharged to the outside of the heat exchanger 200 without reaching the upper surface 53 of the lower end header 50. In the heat exchanger 200 according to Embodiment 2, in addition to frost melt water, the condensed water generated on the entire fins 230 and 240 can be discharged toward the leeward side. As a result, it is possible to inhibit freezing of the upper surface 53 of the lower end header 50 from progressing and a frozen part of the upper surface 53 of the lower end header 50 from expanding. Accordingly, it is possible to reduce impairment of the heat exchange performance and to improve the reliability.

Embodiment 3

In a heat exchanger 300 according to Embodiment 3, the shape of a lower end portion of the fin 30 is changed from that in the heat exchanger 100 according to Embodiment 1. The heat exchanger 300 according to Embodiment 3 is described with the focus on the differences between Embodiment 1 and Embodiment 3. The parts of the heat exchanger 300 according to Embodiment 3 having the same functions in the drawings are represented to have the same reference signs as those in the drawings used in the description of Embodiment 1.

Figure 11:
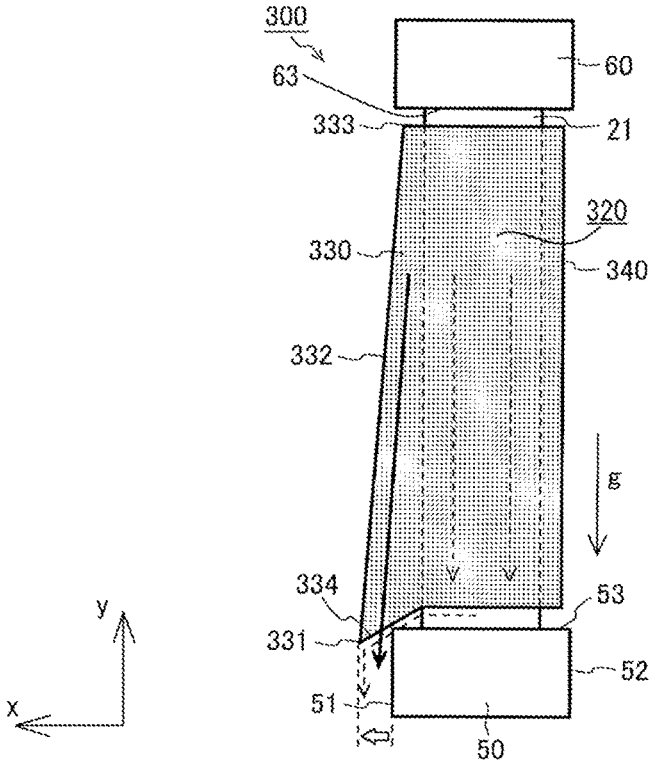
FIG. 11 is a side view of a heat exchanger according to Embodiment 3.

FIG. 11 is a side view of the heat exchanger 300 according to Embodiment 3. A heat transfer tube unit 320 is formed by connecting a fin 330 and a fin 340 to the heat transfer tube 21 of the heat exchanger 300. The heat exchanger 300 is similar to the heat exchanger 100 according to Embodiment 1 in that a part including an edge 334 facing the header of the fin 330 projects in the x direction relative to the header end surface 51 of the lower end header 50. However, in the heat exchanger 300, the edge 334 facing the header of the fin 330 is inclined toward the lower end header 50, and an end 331 is positioned below the upper surface 53 of the lower end header 50. That is, the end 331 of the edge 334 facing the header is positioned closer to the header 50 than an end closer to the heat transfer tube 21 of the edge 334 is.

Effects of Embodiment 3

The heat exchanger 300 is formed as described above, and thus the water remaining on the boundary portion between the heat transfer tube 21 and the upper surface of the lower end header 50 and remaining in a space between the fin 330 and the upper surface of the lower end header 50 moves along the edge 334 facing the header and then drops from the end 331. The edge 334 facing the header is inclined, toward the end 331 from a part closer to the heat transfer tube 21 of the edge 334, downward from above the upper surface 53 of the lower end header 50. The water remaining on the upper surface 53 flows along the slant of the edge 334 facing the header due to capillary action. Thus, the water moving along the heat transfer tube 21 and the fin 330 and then remaining on the upper surface 53 of the lower end header 50 is efficiently discharged. As a result, it is possible to inhibit freezing of the upper surface 53 of the lower end header 50 from progressing and a frozen part of the upper surface 53 of the lower end header 50 from expanding. Accordingly, it is possible to reduce impairment of the heat exchange performance and to improve the reliability.

In Embodiment 3, although the edge 334 facing the header of the fin 330 is inclined downward in a straight line from the part closer to the heat transfer tube 21 of the edge 334, the edge 334 may have other shapes as long as the end 331 is positioned below the upper surface 53 of the lower end header 50. For example, the edge 334 facing the header may be formed by an arc and can be modified as appropriate according to, for example, the shape of the lower end header 50.

Figure 12:
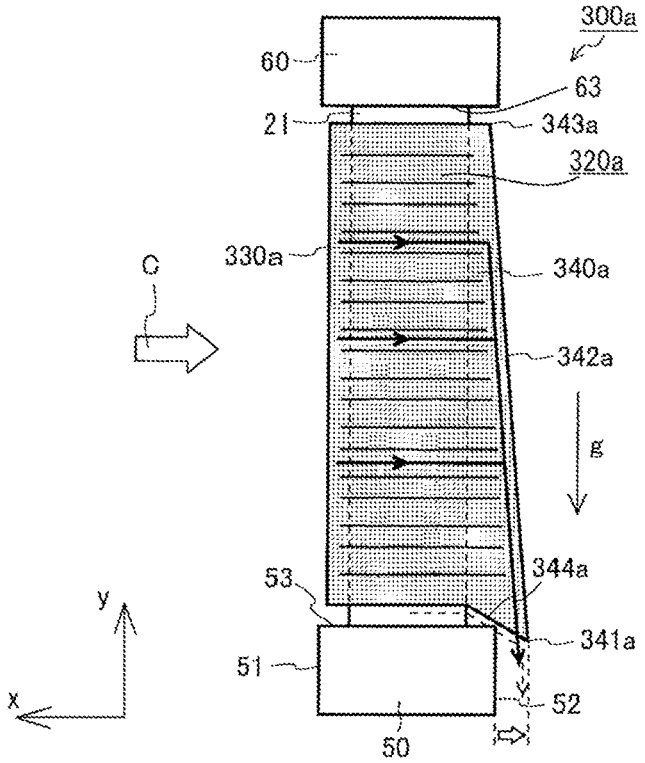
FIG. 12 is a side view of a heat exchanger that is a modification of the heat exchanger according to Embodiment 3.

FIG. 12 is a side view of a heat exchanger 300*a*, which is a modification of the heat exchanger 300 according to Embodiment 3. A heat transfer tube unit 320*a* is formed by connecting a fin 330*a* and a fin 340*a* to the heat transfer tube 21 of the heat exchanger 300*a*. The configuration of the heat exchanger 300*a* is similar to the configuration in which an end edge 332 of the fin 330 of the heat exchanger 300 faces leeward. That is, an end 341*a* of an edge 344*a* facing the header is positioned closer to the header 50 than an end closer to the heat transfer tube 21 of the edge 344*a* is. The heat exchanger 300*a* is formed as described above and thus easily discharges the water remaining on the upper surface 53 of the lower end header 50 more efficiently than the heat exchanger 200 according to Embodiment 2.

Embodiment 4

In a heat exchanger 400 according to Embodiment 4, the fin is changed from the fin 30 in the heat exchanger 100 according to Embodiment 1 into a corrugated fin. The heat exchanger 400 according to Embodiment 4 is described with the focus on the differences between Embodiment 1 and Embodiment 4. The parts of the heat exchanger 400 according to Embodiment 4 having the same functions in the drawings are represented to have the same reference signs as those in the drawings used in the description of Embodiment 1.

Figure 13:
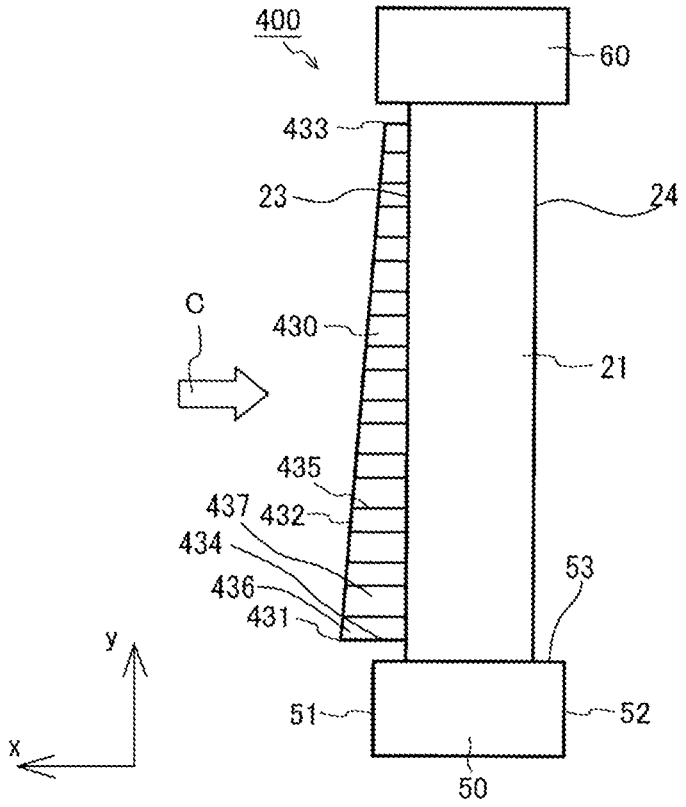
FIG. 13 is a side view of a heat exchanger according to Embodiment 4.
Figure 14:
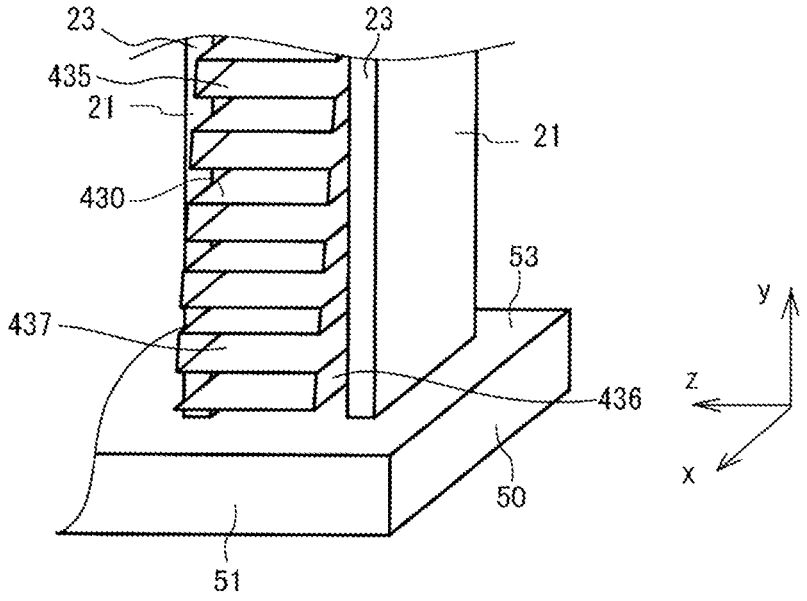
FIG. 14 is a perspective view of the periphery of a lower end header of the heat exchanger according to Embodiment 4.

FIG. 13 is a side view of the heat exchanger 400 according to Embodiment 4. FIG. 14 is a perspective view of the periphery of the lower end header 50 of the heat exchanger 400 according to Embodiment 4. In the heat exchanger 400, a corrugated fin 430 is disposed between the two heat transfer tubes 21. In FIG. 14, although the corrugated fin 430 is formed by bending a flat plate at a right angle to be winding, the shape of the corrugated fin 430 is not limited to this shape. For example, the corrugated fin 430 can be formed by bending a flat plate into a wavy pattern.

The configuration of the corrugated fin 430 is similar to the configuration of the heat exchanger 100 according to Embodiment 1 in that a part including an edge 434 facing the header of the corrugated fin 430 projects relative to the header end surface 51 of the lower end header 50. A wavy part of the corrugated fin 430 is arranged in the y direction and is formed such that the air sent into the heat exchanger 400 passes through spaces in the wavy part of the corrugated fin 430. In addition, the corrugated fin 430 is formed such that air passes between the heat transfer tubes 21. That is, parts at the same phases of the wavy part of the corrugated fin 430 are disposed along the x direction. From the perspective illustrated in FIG. 13, a plurality of ridges 436 and recesses 437, which extend in the x direction, are formed on a surface of the corrugated fin 430. Openings or notches may be formed in the corrugated fin 430. Frost melt water and condensed water can drop through openings or notches.

The corrugated fin 430 is disposed between the two heat transfer tubes 21. An end edge 432 of the corrugated fin 430 projects in the x direction relative to the one end portion 23 of the major axis of the heat transfer tube 21. A first portion that is a part of the corrugated fin 430 and that includes the edge 434 facing the lower end header 50 of the corrugated fin 430 projects in the x direction relative to the header end surface 51. An end 431 of the edge 434 facing the header projects in the x direction relative to the header end surface 51. The lower end header 50 does not exist under the end 431. The end 431, which is positioned closer to the lower end header 50, of the end edge 432 of the corrugated fin 430 projects in the x direction relative to the header end surface 51, which is one end surface of the lower end header 50. An end 433, which is positioned closer to the upper end header 60, of the end edge 432 is positioned closer to the heat transfer tube 21 than the header end surface 51, which is one end surface of the lower end header 50, is. The end edge 432 is formed by a straight line inclined relative to the longitudinal tube axis of the heat transfer tube 21 from the end 433 closer to the upper end header 60 toward the end 431 closer to the lower end header 50.

Figure 15:
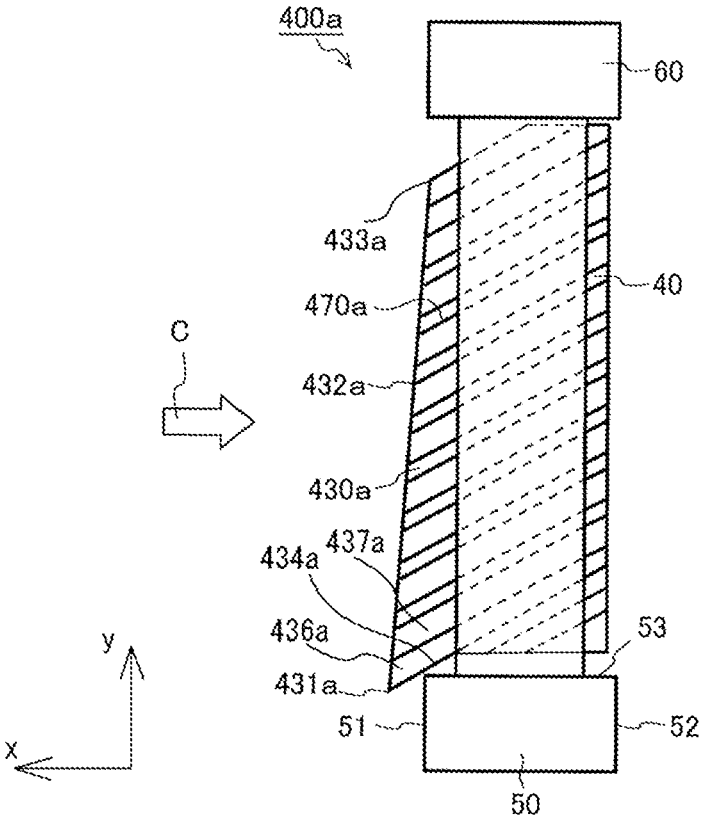
FIG. 15 is a side view of a heat exchanger as a modification of the heat exchanger according to Embodiment 4.

FIG. 15 is a side view of a heat exchanger 400*a* as a modification of the heat exchanger 400 according to Embodiment 4. The heat exchanger 400*a* is disposed such that a wavy part of a corrugated fin 430*a* is inclined. From the perspective illustrated in FIG. 15, a plurality of ridges 436*a* and recesses 437*a* are formed on a surface of the corrugated fin 430*a*. The ridges 436*a* and the recesses 437*a* are inclined toward the lower end header 50 in the x direction. An end 431*a* closer to the lower end header 50 of the corrugated fin 430 of the heat exchanger 400 is formed to be positioned below the upper surface 53.

The end edges 432 and 432*a* of the corrugated fins 430 and 430*a* can be shaped like, for example, the end edges 32*a* to 32*c* of the fins 30*a* to 30*c* in Embodiment 1. In addition, similarly to Embodiment 2, the end edges 432 and 432*a* of the corrugated fins 430 and 430*a* may face leeward.

Effects of Embodiment 4

The corrugated fin 430 is disposed in the heat exchangers 400 and 400*a* according to Embodiment 4, and thus the heat exchangers 400 and 400*a* according to Embodiment 4 have the advantage of high heat exchange performance. In addition, frost melt water and condensed water move downward and are discharged from the end 431 of the lower end header 50 of the corrugated fin 430. As a result, similarly to Embodiment 1 to Embodiment 3, in the heat exchangers 400 and 400*a*, it is possible to inhibit freezing of the upper surface 53 of the lower end header 50 from progressing and a frozen part of the upper surface 53 of the lower end header 50 from expanding. Accordingly, it is possible to reduce impairment of the heat exchange performance and to improve the reliability.

In addition, when the wavy part of the corrugated fin 430*a* is disposed to be inclined as in the case of the heat exchanger 400*a*, the water adhering to the corrugated fin 430*a* easily moves toward the end edge 432. The water that has moved to the end edge 432 moves along the end edge 432*a*, reaches the end 431*a*, and is then discharged downward. Thus, it is possible to discharge water more efficiently. In addition, the end 431*a* is positioned below the upper surface 53 of the lower end header 50. Thus, the end 431*a* is formed such that the water remaining on the upper surface 53 also moves along an edge 434*a* facing the header due to capillary action and is easily discharged.

REFERENCE SIGNS LIST

1 refrigeration cycle apparatus 2 fan 3 compressor 4 four-way valve outdoor heat exchanger 6 expansion device 7 indoor heat exchanger 8 outdoor unit 9 indoor unit 10 heat exchange unit 20 heat transfer tube unit heat transfer tube 22 refrigerant passage 23 end portion 24 end portion 30 fin 30*a* fin 30*b* fin 30*c* fin 31 end 31*a* end 31*b* end 31*c* end 32 end edge 32*a* end edge 32*b* end edge 32*c* end edge 33 end 33*b* end 34 edge line facing header 35*b* center 40 fin 50 lower end header 51 header end surface 52 header end surface 53 upper surface 60 upper end header 70 water guide 80 plate-like part 90 refrigerant pipe 100 heat exchanger 100*a* heat exchanger 100*b* heat exchanger 100*c* heat exchanger 100*d* heat exchanger 200 heat exchanger 230 fin 240 fin 241 end 242 end edge 244 edge facing header 270 water guide 300 heat exchanger 300*a* heat exchanger 330 fin 331 end 334 edge facing header 400 heat exchanger 400*a* heat exchanger 430 corrugated fin 430*a* corrugated fin 431 end 431*a* end 432 end edge 432*a* end edge 433 end 434 edge facing header 434*a* edge facing header 436 ridge 436*a* ridge 437 recess 437*a* recess 1030 fin 1032 end edge 1100 heat exchanger A section B arrow C arrow D first direction

The invention claimed is:

1. A heat exchanger comprising:

a plurality of heat transfer tubes arranged such that the tube axes of the plurality of heat transfer tubes are in parallel with each other;

a fin connected to one of the plurality of heat transfer tubes;

a header being connected to one end portions of the plurality of heat transfer tubes, the fin extending in a first direction crossing a direction in which the tube axes are arranged in parallel with each other, the first direction being perpendicular to the tube axes, the fin having at least a part protruding in the first direction from an edge of the plurality of heat transfer tubes, the part including a first portion including an edge facing the header in the direction of the tube axes and a second portion other than the first portion, the header having a header end surface facing the first direction and being a surface along the direction in which the tube axes are arranged in parallel with each other, wherein an end portion in the first direction of the first portion projects in the first direction relative to the header end surface, and an end portion in the first direction of the second portion is positioned closer in the first direction to the plurality of heat transfer tubes than the header end surface is to the plurality of heat transfer tubes.

2. The heat exchanger of claim 1, wherein the part of the fin that protrudes in the first direction from the edge of the plurality of heat transfer tubes has an end positioned away from the edge of the plurality of heat transfer tubes in the first direction, the end of the fin including a part disposed closer to other end portions of the plurality of heat transfer tubes than to the one end portions of the plurality of heat transfer tubes, the part of the end of the fin is positioned closer to the edge of the plurality of heat transfer tubes than the header end surface in the first direction, and the end of the fin is inclined in the first direction from the other end portions of the plurality of heat transfer tubes toward the header.

3. The heat exchanger of claim 1, wherein a water guide is formed on a surface of the fin.

4. The heat exchanger of claim 3, wherein the water guide is inclined toward the header in the first direction.

5. The heat exchanger of claim 1, wherein the edge facing the header includes an end positioned away from the edge of the plurality of heat transfer tubes in the first direction, and the end of the edge is positioned closer to the header than another end of the edge closer to the plurality of heat transfer tubes is to the header.

6. The heat exchanger of claim 1, wherein the plurality of heat transfer tubes are flat tubes, and a major axis of a section of each of the plurality of heat transfer tubes is disposed along the first direction.

7. The heat exchanger of claim 1, wherein the fin is a plate-like part connected to the plurality of heat transfer tubes.

8. The heat exchanger of claim 1, wherein the fin is a corrugated fin disposed between the plurality of heat transfer tubes.

9. The heat exchanger of claim 8, wherein the corrugated fin is inclined toward the header in the first direction.

10. A heat exchanger unit comprising the heat exchanger of claim 1.

11. The heat exchanger unit of claim 10, further comprising a fan configured to send air into the heat exchanger, wherein the heat exchanger is disposed such that a part where the fin extends of the heat exchanger faces windward.

12. The heat exchanger unit of claim 10, further comprising a fan configured to send air into the heat exchanger, wherein the heat exchanger is disposed such that a part where the fin extends of the heat exchanger faces leeward.

13. The heat exchanger unit of claim 10, wherein the heat exchanger is disposed such that the header is positioned below the other end portions of the plurality of heat transfer tubes.

14. A refrigeration cycle apparatus comprising the heat exchanger unit of claim 10.

* * * * *